United States Patent [19]

Lerner et al.

[11] 4,330,046

[45] May 18, 1982

[54] SOUND BARRIER

[76] Inventors: Armand Lerner, 100 E. Hartsdale, Hartsdale, N.Y. 10530; Sylvain S. Lerner, 301 E. 79th St., New York, N.Y. 10020

[21] Appl. No.: 277,676

[22] Filed: Jun. 26, 1981

Related U.S. Application Data

[63] Continuation-in-part of Ser. No. 79,784, Sep. 28, 1979, Pat. No. 4,278,146.

[51] Int. Cl.[3] ..... G10K 11/04; E04B 1/84; E04B 1/99

[52] U.S. Cl. ..... 181/210; 181/289; 181/291; 181/295; 52/144

[58] Field of Search ..... 181/210, 284–295; 52/144–145

[56] References Cited

U.S. PATENT DOCUMENTS

| | | | |
|---|---|---|---|
| 2,007,374 | 7/1935 | Kuehne | 52/145 |
| 2,175,630 | 10/1939 | Kiesel | 181/284 X |
| 4,016,689 | 4/1977 | Wendt | 181/284 |
| 4,094,379 | 6/1978 | Steinberger | 181/284 |

FOREIGN PATENT DOCUMENTS

| | | | |
|---|---|---|---|
| 222770 | 8/1958 | Australia | 181/292 |

*Primary Examiner*—L. T. Hix
*Assistant Examiner*—Thomas H. Tarcza
*Attorney, Agent, or Firm*—Henry R. Lerner

[57] ABSTRACT

A sound barrier for isolating a noise source of the type emanating from manufacturing areas for food. The sound barrier comprises a panel made of sound attenuating material having a plurality of longitudinally extending side by side co-planar sections separated by V-shaped ribs so as to define a plurality of longitudinally extending side by side cavities. The cavities are provided with acoustical absorptive material therein so that the sound waves emanating from the noise source are first absorbed by the acoustical absorptive material and thereafter partly attenuated by the panel and partly deflected thereby so as to be absorbed again by the acoustical absorptive material. The panel is preferably transparent and portions of at least some cavities may be left free of acoustical absorptive material so as to provide undistorted vision from one side of the panel to the opposite side thereof. The sound barrier is intended to be disposed so that the open faces of the cavities confront the noise source. Alternatively, the cavities are separated by flat panel sections instead of V-shaped ribs, which sections are free of acoustical absorptive material to provide undistorted vision therethrough.

5 Claims, 8 Drawing Figures

SOUND BARRIER

RELATED APPLICATION

This is a continuation-in-part application Ser. No. 79,784 filed Sept. 28, 1979, now U.S. Pat. No. 4,278,146 dated July 14, 1981.

BACKGROUND OF THE INVENTION

Noise control has always been a problem in connection with industries which require FDA and/or USDA acceptance as, for example, when providing sound barriers to isolate sound emanating from manufacturing areas for food and the like.

The reason for this state of affairs is that, in order to comply with OSHA requirements for noise reduction, the type of acoustical treatment previously available was incompatible with the stringent sanitary requirements of FDA and/or USDA and such acoustical treatment was usually not economically produceable by prior art manufacturing techniques.

The most pertinent prior art sound barrier purporting to deal with these problems is that shown in U.S. Pat. No. 4,094,379 issued June 13, 1978. The barrier in accordance with this patent, however, leaves much to be desired. More specifically, the basic panel is formed of surfaces angularly related to the line of sight thus creating optical distortion when viewing through the panel. Further, the sound absorbing body forming part of the panel is mounted so as to be easily, though inadvertently, displaced or possibly broken loose. Further, such sound absorbing body forms a juncture with the panel proper so as to provide acute angles therebetween defining receptacles for easy accumulation of dirt whereby the cleaning thereof in a manner satisfactory to FDA and/or USDA requirements is rather difficult. Further, the depth of the panel, approximately 4", takes up substantial and valuable space, particularly in a retrofit situation. Further yet, the basic acoustical arrangement of said prior art patent does not provide maximum noise reduction.

SUMMARY OF THE INVENTION

In accordance with one embodiment of the invention, there is provided a modular sound barrier which effectively attenuates noise by means of sound transmission loss and sound absorption. The sound barrier includes a basic panel configuration whose major portions lie in a plane perpendicular to the line of sight extending from the noise source on one side of the panel to the observation point on the opposing side of the panel, thus avoiding optical distortion when viewing through those portions of the panel which are left uncovered by acoustical absorptive elements.

The panel is made of a sound attenuating material, provided with acoustical absorptive elements so that the sound waves are absorbed by the acoustical absorptive elements prior to reaching the surface of the panel sound attenuating material, whereby the remaining sound waves which are not fully absorbed by the acoustical absorptive element are deflected back through said sound absorptive element or else are attenuated by the sound attenuating material.

The panel is basically formed of flat sections separated by V-shaped ribs so as to define a plurality of side-by-side cavities which are adapted to receive acoustical absorptive material therewithin. Selected portions of the cavities may be left uncovered by acoustical absorptive material to define means through which unobstructive view can be obtained from one side of the panel to the opposite side thereof where the noise source is located.

The acoustical absorptive elements are preferably self-contained units which can easily be secured into the cavities in recessed condition, thus avoiding the possibility of inadvertently displacing or dislocating the acoustical absorptive elements. Furthermore, the panel construction is such that the ribs which interconnect the adjacent flat sections of the panel, define obtuse angles therebetween, further facilitating the cleaning operation since any dirt accumulated in the panel is easily accessible, contrary to the situation where the absorptive elements define an acute angle with their supporting panel. The acoustical absorptive material usually comprises a conventional sound absorbing foam covered by a plastic film so that the unit can be easily cleaned, does not retain soil or wash water and is self draining. The acoustical absorptive material unit is sealed within the panel by a continuous smooth non-peeling and inert caulking material.

Because of the construction of this modular panel, namely, the flat sections maintained in side-by-side relation by intermediate V-shaped ribs, the unit is free standing and can be built up in a modular fashion into a barrier of any predetermined size. Further, the relative arrangement between panel and absorptive elements is such as to provide maximum noise reduction so that the panel in accordance with the invention provides a barrier far superior to that previously used and known.

In accordance with another embodiment of the invention, the cavity containing the acoustical absorptive material is defined by a flat section, which forms the base of the cavity, and opposite sidewalls which extend, initially, perpendicular to the base and thereafter diverge in an angular direction. The upper ends of the sidewalls of adjacent cavities are interconnected by a flat panel section which remains transparent and which is parallel to the cavity base.

DESCRIPTION OF THE PREFERRED EMBODIMENTS

Figure 1:
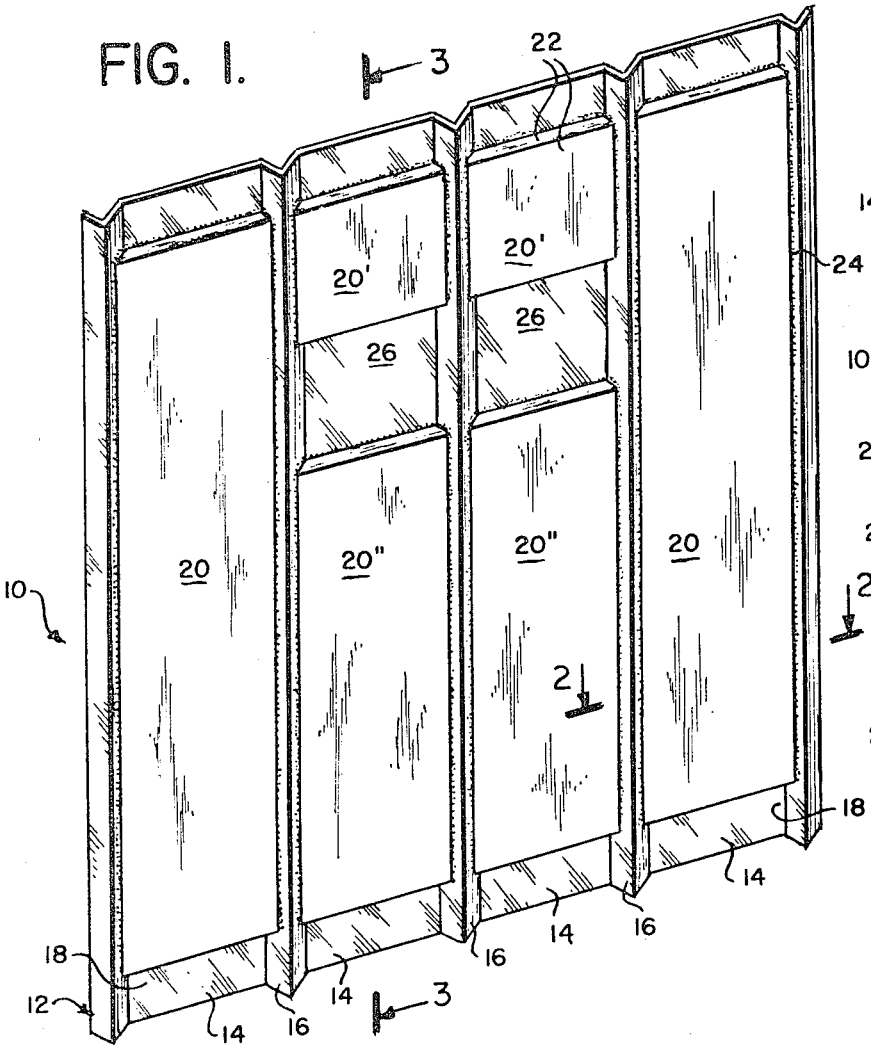
FIG. 1 is a front perspective view of the sound barrier in accordance with the invention.
Figure 3:
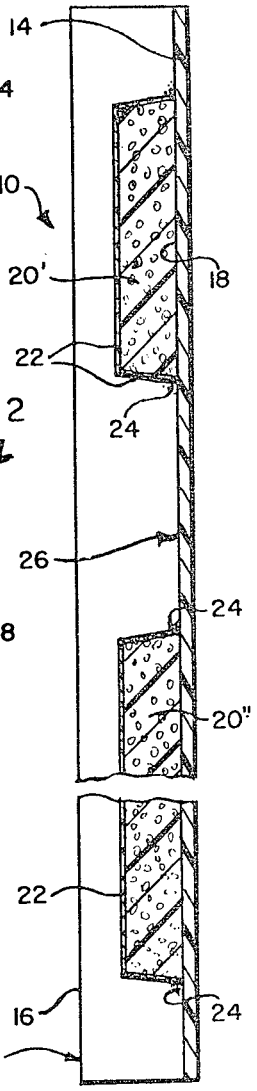
FIG. 3 is a section taken along line 3—3 of FIG. 1.
Figure 2:
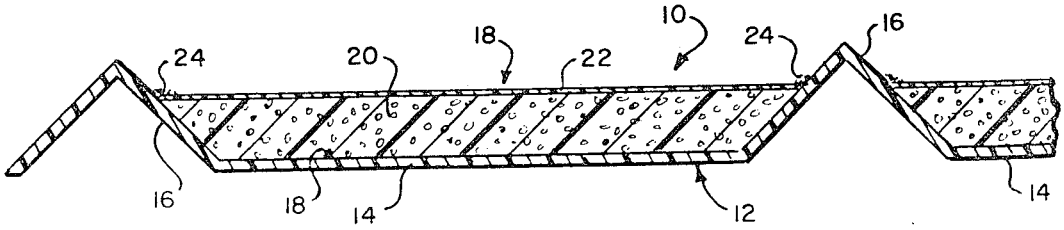
FIG. 2 is a section taken along line 2—2 of FIG. 1, showing the cross section of a typical panel portion.

Referring now to FIGS. 1, 2 and 3 of the drawings, three is shown a sound barrier 10 in accordance with the invention comprising a modular panel 12 made of transparent rigid plastic material, commercially sold as Uvex®. Panel 12 includes a series of side-by-side upstanding coplanar sections 14 separated by V-shaped ribs 16, said sections 14 cooperating with said ribs 16 to define spaced vertically extending cavities 18. Cavities 18 receive self-contained units 20 of acoustical absorptive material which may be made of cellular structural material such as plastic foam whose outer or exposed surfaces are covered by a plastic protective film 22. This film 22 serves as a membrane which permits sound waves to readily impinge upon the acoustical absorptive member 20 thereby minimizing the loss in the sound absorptive characteristics of element 20. This plastic film, when properly applied to the acoustical absorptive member 20, increases the sound absorptive characteristics of lower octave bands. The film further permits the acoustical absorptive element 20 to be easily cleaned with hot water and sanitizing solutions so as to meet FDA/USDA acceptance requirements. Elements 20 are preferably modular standard units of basically open cell low density impact absorbing and sound absorbing material so that when necessary, these can be replaced unit by unit in a simplified manner.

As shown in FIGS. 1 and 2, the acoustical absorptive material 20 fills more than half the cavity 18 but does not fill it completely so that the acoustical absorptive material is recessed within the cavity thus making it virtually impossible for such material to be inadvertently contacted. Preferably, a sealant 24 is provided for sealing the peripheral edges of the acoustical absorptive element 20, within its cavity.

When in use the sound barrier 10, in its vertically free standing condition, is positioned so that the peaks of ribs 16 (which form an included angle of approximately 90°) and the acoustical absorptive element 20 face the noise source. Viewing FIG. 2, therefore, the noise source would be located above the sound barrier with the area below the sound barrier being that intended to be acoustically insulated from said noise.

As previously stated, it is desirable to provide means for permitting viewing from one side of the sound barrier, through the sound barrier, the area which is intended to be acoustically insulated by said barrier. For such purpose, as shown in FIG. 1, portions 26 of one or more cavities 18 are left unprovided with acoustical absorptive material 20 thus defining transparent viewing portions unobstructed by the acoustical absorptive material. As previously noted, upstanding sections 14 of panel 12 are planar and in a plane perpendicular to the line of sight extending through the panel so that the vision through unobstructed portions 26 of the panel are not optically distorted as would be the case if these portions were in a plane forming an angle with the line of sight.

The viewing portion 26 is also illustrated in FIG. 3 which further shows that such viewing portion separates acoustical absorptive section 20 into upper component 20' and lower component 20''. In this connection, it will further be noted that the upper and lower edges of sections 20' and 20'' are sloped downwardly and upwardly, respectively, approximately 10° to 15°, these slopes being for the purpose of further broadening the field of vision of the area through section 26, to facilitate cleaning, and to automatically enable drainage of wash water.

It will also be noted, with particular reference to FIG. 2, that the juncture of the acoustical absorptive element 20 with panel 12, at ribs 16, is at an obtuse angle making it quite easy for the cleaning of such juncture, especially as compared to a construction wherein such juncture is defined by an acute angle.

The viewing sections 26 as well as the peaks of the ribs 16 which are not covered by acoustical absorptive material permit the transmission of light from one side of the barrier to the other.

Figure 4:
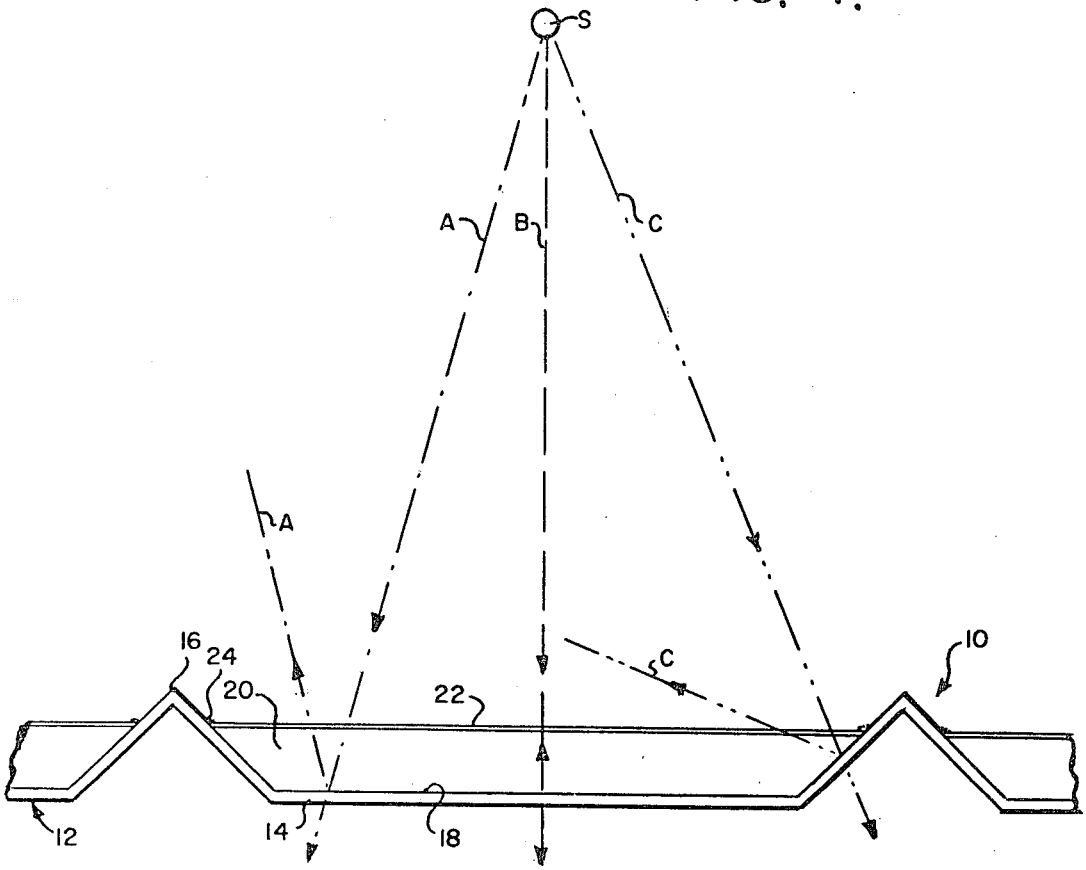
FIG. 4 is a schematic illustrating the manner in which the sound barrier in accordance with the invention absorbs and attenuates the sound waves.

FIG. 4 illustrates schematically the functioning of the sound barrier in accordance with the invention. In FIG. 4, S identifies the noise source, there being shown three separate sound waves A, B and C emanating therefrom. As to sound wave A, the same is seen to angularly impinge acoustical absorptive element 20 which absorbs a substantial portion of the wave intensity. The unabsorbed portion then proceeds and impinges upon plastic panel 14 where part thereof is reflected and thus passes through acoustical absorptive element 20 a second time, the remainder passing through panel 14 which attenuates a substantial part of the sound wave, permitting transmittal to the opposite side thereof of only a relatively small remaining portion thereof. Sound wave B emanating from noise source S impinges acoustical absorptive element 20 head on wherein it is partially absorbed with a substantial part of the remainder being reflected back towards the noise source and only a small unattenuated portion passing through panel 14. Sound wave C which is typical of only a very small portion of the emanating sound waves is seen to angularly impinge acoustical absorptive element 20 which absorbs a portion of the wave intensity. The unabsorbed portion then proceeds and impinges upon the rib of plastic panel 14 where part thereof is reflected and thus passes through acoustical absorptive element 20 a second time, the remainder passing through rib of panel 14 which attenuates a substantial part of the sound wave, permitting transmittal to the opposite side thereof of only a relatively small remaining portion thereof. Thus it is seen that the bulk of the sound waves emanating from a noise source pass through the acoustical absorptive element twice with only a very small unattenuated portion thereof passing through the opposite side of the panel, whereby a noise reduction capable of compliance with OSHA requirements may be effectuated. It will be understood that the acoustic performance of the barrier can be varied by changing the thickness of the sound absorbing foam and the dimensions of the plastic panel. In this connection, the plastic panel is contemplated as being approximately 3/16" thick and 2" deep from the tip of the rib to the back of the panel. This depth decreases the amount of required space, particularly important in a retrofit situation.

Figure 5:
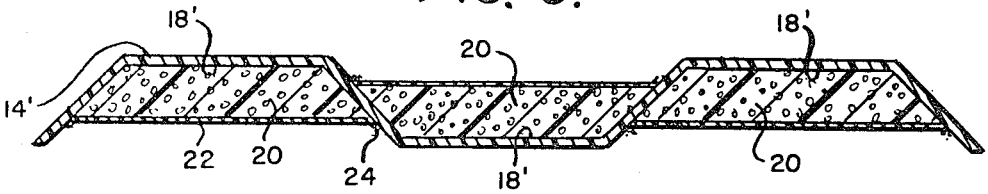
FIG. 5 is a sectional view of another embodiment of the invention.

FIG. 5 represents a modification of the sound barrier in accordance with the invention. In accordance with such modification, panel 14' is provided with cavities 18' filled with acoustical absorptive material 20 which alternately face opposite sides of the sound barrier so that sound waves from each side of the barrier can be absorbed and attenuated in a manner substantially similar to that shown in FIG. 4. The sound barrier of FIG. 5 is free standing in the same manner as that of FIGS. 1 through 4 and may also be provided with vision areas at appropriate locations on the sound barrier.

Figure 6:
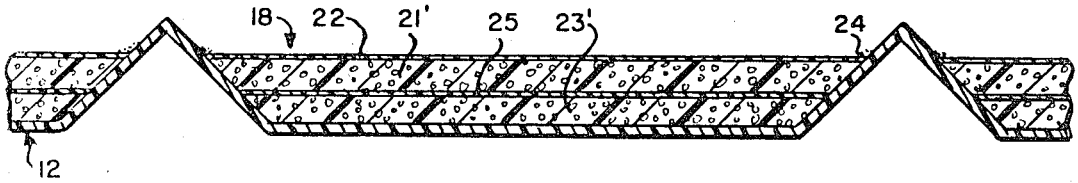
FIG. 6 is a sectional view of yet another embodiment of the invention.

FIG. 6 represents another embodiment in which the cavity 18 is provided with two separate layers of acoustical absorptive material 21' and 23', respectively, there being provided therebetween a sheet of septum material 25. This septum material 25 which is preferably a limp high density plastic sheet defines an additional sound attenuating panel for further increasing the noise reduction of the sound barrier. Another way of effectuating such further noise reduction is to increase the thickness of panel 12 and this can be done in the embodiment of FIG. 6 as well as in the embodiments of FIGS. 1 through 5.

It will be noted, in connection with the embodiments heretofore described, that the self-contained units 20 of acoustical absorptive material are trapezoidally shaped, having two opposite angularly related faces obtained by cutting the foam incorporated in said units at 45° angles. Such procedure tends to be relatively uneconomical as compared to the use of self-contained units which are simply rectangularly shaped. Accordingly, there is provided in accordance with the invention yet another embodiment illustrated in FIGS. 7 and 8 which utilizes self-contained units of acoustical absorptive material which are rectangular or box shaped.

Figure 7:
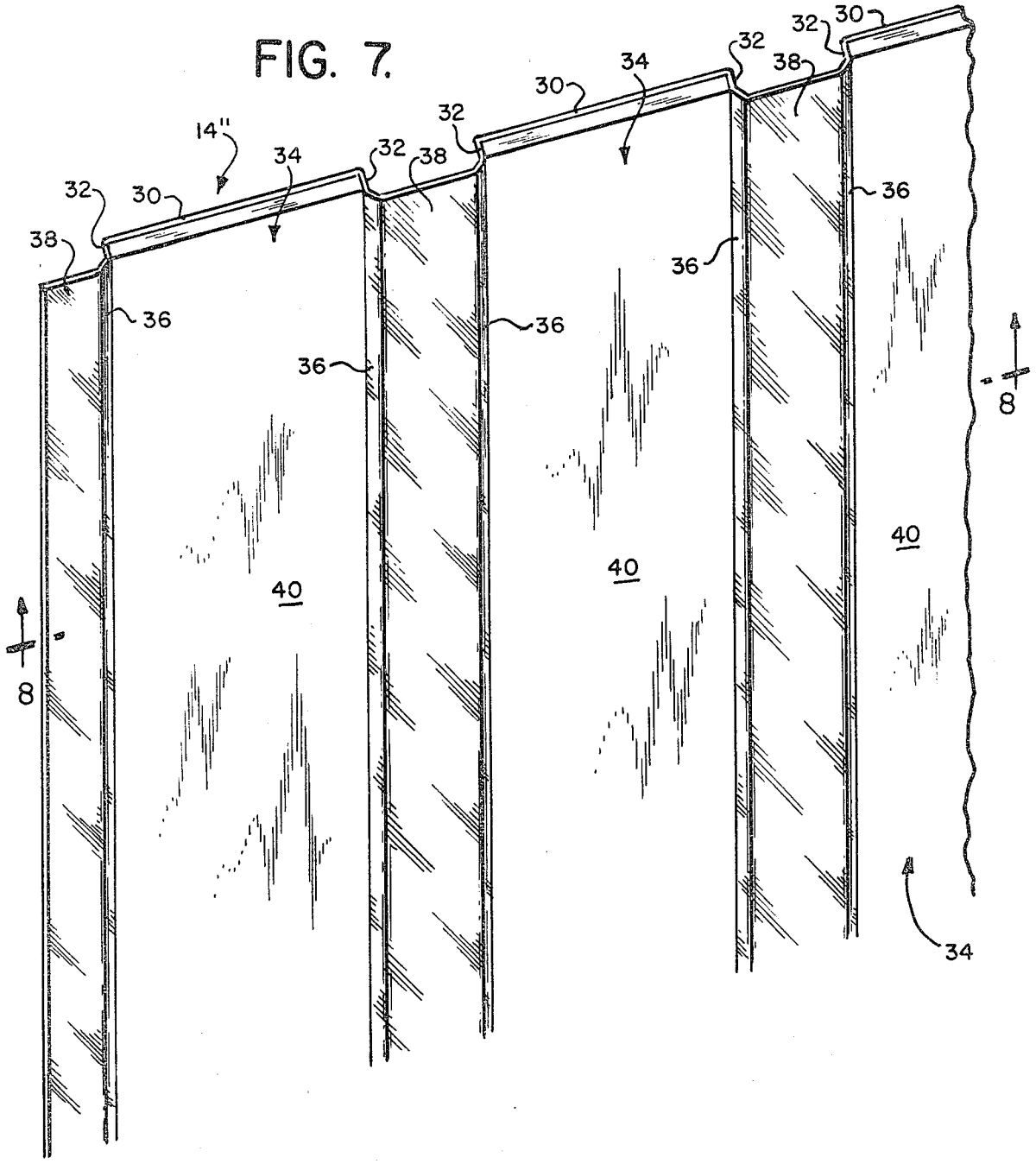
FIG. 7 is a front perspective view of the sound barrier in accordance with yet another embodiment of the invention.
Figure 8:
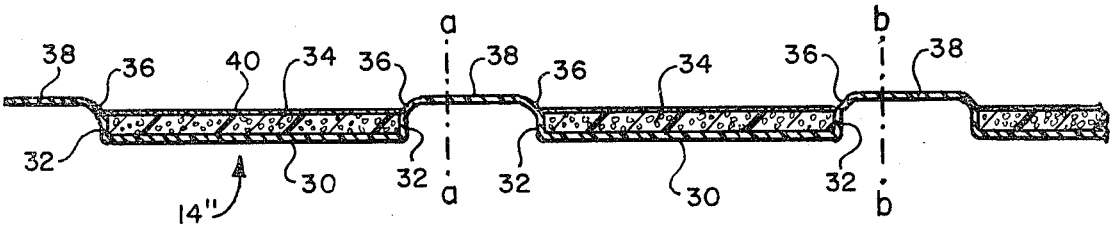
FIG. 8 is a sectional view taken along line 8—8 of FIG. 7.

In accordance with the embodiment of FIGS. 7 and 8 the panel 14″ comprises a plurality of co-planar flat sections 30 bounded, at opposite sides thereof, with upstanding sidewalls 32 to define cavities which are adapted to contain the more economical rectangular units 34 of acoustical absorptive material. Sidewall portions 32 extend into portions 36 which diverge away from the cavity, and such diverging portions of adjacent cavities are interconnected by flat panel sections 38 to define a continuous sound barrier.

In a conventional arrangement the cavity width between sidewalls 32 is approximately 16″, and the spacing between adjacent cavities is approximately half that distance, namely 8″.

As in the other embodiments the acoustical absorptive units 34 are self-contained units whose outer surface is covered by plastic protective film 40.

It will be apparent that the embodiment in accordance with FIGS. 7 and 8 is free standing with the cavities being maintained in side by side relation by intermediate panel connecting sections 38. Further, since panel sections 38 are in a plane perpendicular to the line of sight extending through the panel, vision through panel sections 38 is unobstructed and optically undistorted, as desired. This makes it unnecessary to leave selected portions of the cavities unfilled by the acoustical absorptive material.

It will be noted, as in the earlier described embodiments, that the juncture of the acoustical absorptive material 34 with the panel is at least 90° so that cleaning of these junctures is easily accomplished. In this connection, it will further be noted that the acoustical foam material fills the respective cavities up to the point where sidewalls 32 diverge into angularly directed sections 36.

It will be understood that a sound barrier usually consists of a plurality of side by side cavities and such barrier can be formed of a one piece panel unit. Alternatively, the sound barrier can be made of individual panel sections easily interconnected in modular side by side fashion by conventional bracing means. Typically, one such individual panel section is shown in FIG. 8 as extending between line a—a and line b—b.

In each embodiment of the invention, the panel is basically rigid and has a smooth surface which is parallel to the acoustical absorptive element adhered thereto. Further in the embodiments of FIGS. 1 through 6, wherever a vision area is desired for viewing or for light transmission, the cavity is left unfilled for the desired extent. In the embodiment of FIGS. 7 and 8 the vision area is defined between adjacent cavities.

Each of the sound barriers in accordance with the invention is a self-supporting structure which can be used as a vertical partition or wall. Alternatively the sound barrier can be supported in horizontal disposition, suitably braced, with the cavities running horizontally rather than vertically.

Any noise source may be enclosed partially or completely with suitable modular configurations of the sound barriers in accordance with the invention in order to eliminate or reduce the noise from the noise source. As has been demonstrated above, each sound barrier is essentially formed by a series of flat cavity defining sections separated by ribs in the embodiment of FIGS. 1 to 6 and by flat interconnecting panel sections in the embodiment of FIGS. 7 and 8. Each cavity is provided with acoustical absorptive material commercially available as polyurethane foam.

The acoustical absorptive material is provided in predetermined self-contained units having the sloping edges previously described and covered with the aforementioned protective film commercially known as Mylar ®.

The modular units are mounted so that the cavities face the noise source so as to effectively absorb and attenuate the sound waves emitted from the noise source in the manner described in connection with FIG. 4 whereby to provide a more than satisfactory noise reduction through the absorption and attenuation functions of the sound barrier. It should also be noted that in each of the embodiments, the major surfaces of the plastic attenuating panel and the outer face of the acoustical absorptive elements within the cavities are parallel to each other and basically perpendicular to the area containing the noise source. This enables the sound waves to penetrate the absorptive acoustical material to thereby reduce the sound intensity after which the remaining sound waves are either deflected back towards the noise source, passing again through the absorptive acoustical material, with the remainder being attenuated by the panel leaving only a portion which is transmitted to the opposite side of the sound barrier.

Having thus described our invention, what we claim and desire to secure by letters patent is:

1. A sound barrier for isolating a noise source comprising, (a) a transparent panel made of sound attenuating material, (b) said panel comprising a plurality of longitudinally extending side by side co-planar flat sections having opposite perpendicularly extending sidewalls, and separated by intermediate sections so as to define a plurality of longitudinally extending side by side cavities, said flat sections comprising the major part of said panel, (c) at least some of said cavities being provided with acoustical absorptive material therein in engagement with the entire transverse extent of the flat sections thereof, (d) said barrier being disposed so that the open faces of said cavities confront said noise source, and with the plane defined by said co-planar flat sections extending vertically.

2. A sound barrier in accordance with claim 1, wherein said intermediate sections include other co-planar flat sections in parallel spaced relationship with said first mentioned co-planar flat sections, said other flat sections providing undistorted vision from one side of said panel to the opposite side thereof.

3. A sound barrier in accordance with claim 2, wherein said sidewalls extend into diverging portions connected to said other co-planar flat sections.

4. A sound barrier in accordance with claim 1, 2 or 3, wherein said acoustical absorptive material has its exposed surface covered with a plastic film which defines a protective membrane therefor.

5. A sound barrier in accordance with claim 4, wherein the juncture of the acoustical absorptive material and the associated sidewalls is defined by an angle of at least 90 degrees.

* * * * *